US008063831B2

(12) United States Patent
Tsai et al.

(10) Patent No.: US 8,063,831 B2
(45) Date of Patent: Nov. 22, 2011

(54) BROADBAND ANTENNA

(75) Inventors: Tiao-Hsing Tsai, Yungho (TW); Chih-Wei Liao, Yilan Shien (TW); Chao-Hsu Wu, Tao Yuan Shien (TW)

(73) Assignee: Quanta Computer Inc. (TW)

( * ) Notice: Subject to any disclaimer, the term of this patent is extended or adjusted under 35 U.S.C. 154(b) by 326 days.

(21) Appl. No.: 12/348,613

(22) Filed: Jan. 5, 2009

(65) Prior Publication Data

US 2010/0045534 A1 Feb. 25, 2010

(30) Foreign Application Priority Data

Aug. 22, 2008 (TW) ..... 97132206 A

(51) Int. Cl.
*H01Q 1/38* (2006.01)

(52) U.S. Cl. ..... 343/700 MS; 343/846

(58) Field of Classification Search ..... 343/700 MS, 343/702, 846, 767
See application file for complete search history.

(56) References Cited

U.S. PATENT DOCUMENTS 6,714,162 B1 * 3/2004 Kadambi et al. ..... 343/700 MS
7,102,573 B2 * 9/2006 Morrow et al. ..... 343/700 MS
7,742,003 B2 * 6/2010 Tseng et al. ..... 343/702

* cited by examiner

*Primary Examiner* — Tan Ho
(74) *Attorney, Agent, or Firm* — Sunstein Kann Murphy & Timbers LLP

(57) ABSTRACT

An antenna includes: a grounding element extending along a first plane; a radiating element having a first side and extending along a second plane substantially parallel to the first plane, the radiating element being aligned with the grounding element in a normal direction transverse to the first and second planes; a bridging element interconnecting the grounding and radiating elements; and a feeding element extending and tapered from the first side of the radiating element toward the grounding element.

9 Claims, 6 Drawing Sheets

BROADBAND ANTENNA

CROSS-REFERENCE TO RELATED APPLICATION

This application claims priority of Taiwanese application no. 097132206, filed on Aug. 22, 2008.

BACKGROUND OF THE INVENTION

1. Field of the Invention

The invention relates to an antenna, more particularly to an antenna including a feeding element extending and reducing in length from a radiating element for increasing the operating frequency bandwidth of the antenna.

2. Description of the Related Art

In recent years, devices, such as notebook PC and Ultra Mobile PC (UMPC), are required to incorporate an antenna that can be operate at frequency bands, such as Worldwide Interoperability for Microwave Access (WiMAX, bandwidth: 2300 MHz to 2700 MHz and 3300 MHz to 3800 MHz), Wireless Local Area Network (WLAN, bandwidth: 2412 MHz to 2462 MHz (802.11b/g) and 4900 MHz to 5875 MHz (802.11a)), and Wireless Personal Area Network (WPAN, bandwidth: 2402 MHz to 2480 MHz (Bluetooth) and 3168 MHz to 4752 MHz (UWB Band I)). Hence, there is a need to increase the bandwidth of the antenna, which can cover the aforementioned frequency bands. In addition, there is further a need for the antenna to have a small size for miniaturization purpose.

SUMMARY OF THE INVENTION

Therefore, an object of the present invention is to provide an antenna that has a bandwidth covering the aforementioned frequency bands and a small size.

According to the present invention, there is provided an antenna that comprises: a grounding element extending along a first plane; a radiating element having a first side and extending along a second plane substantially parallel to the first plane, the radiating element being aligned with the grounding element in a normal direction transverse to the first and second planes; a bridging element interconnecting the grounding and radiating elements; and a feeding element extending and tapered from the first side of the radiating element toward the grounding element.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
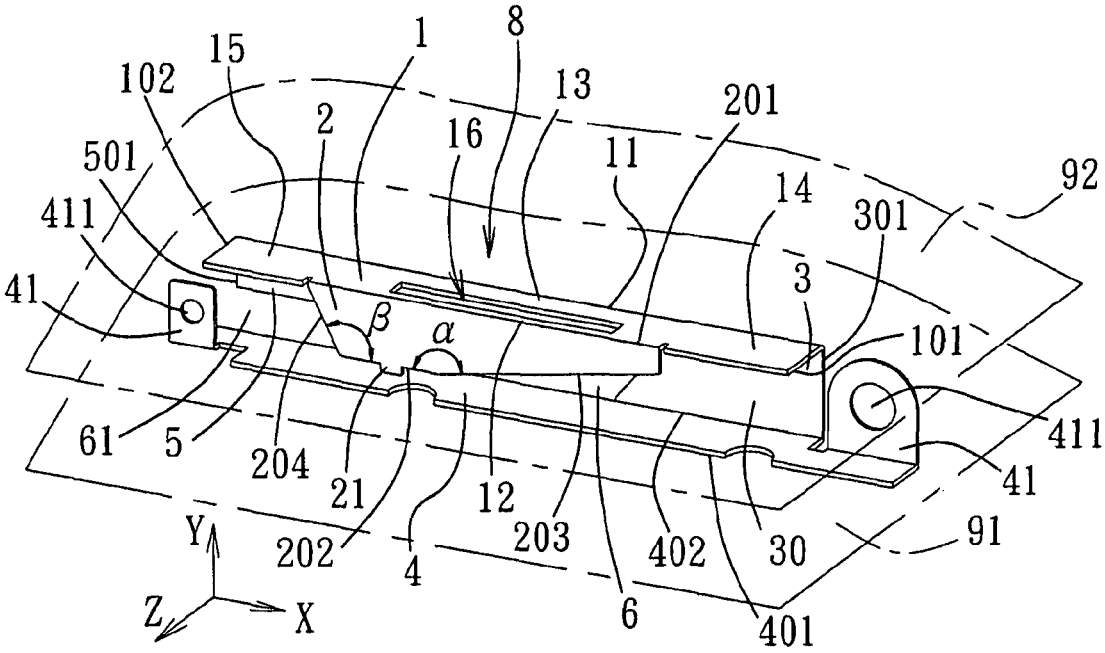
FIG. 1 is a perspective view of the preferred embodiment of an antenna according to this invention.
Figure 2:
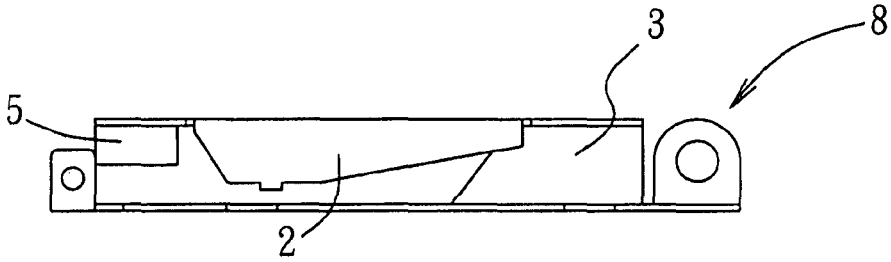
FIG. 2 is a front view of the preferred embodiment.
Figure 3:
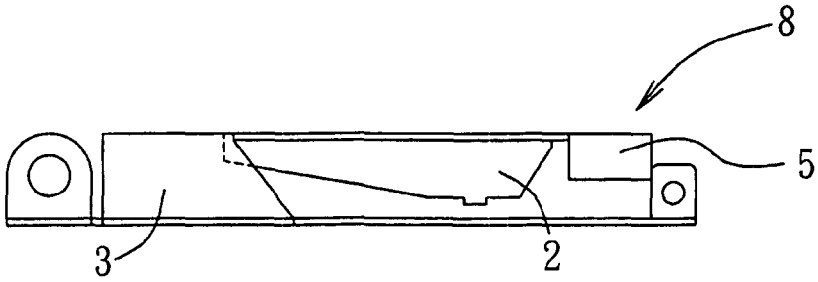
FIG. 3 is a rear view of the preferred embodiment.
Figure 4:
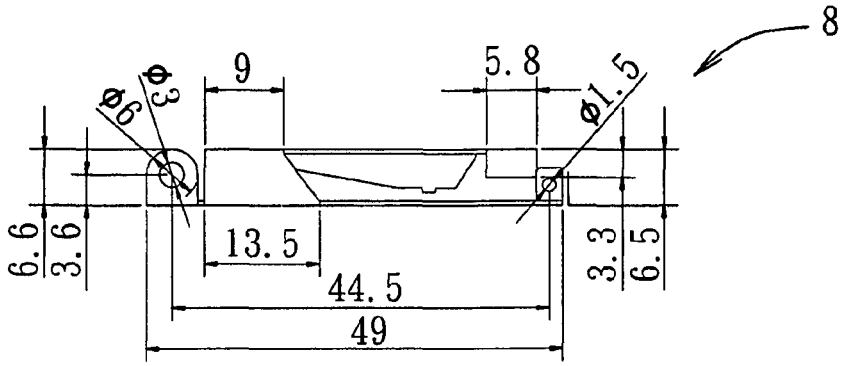
FIG. 4 is a rear view showing the dimensions of different portions of the preferred embodiment.
Figure 5:
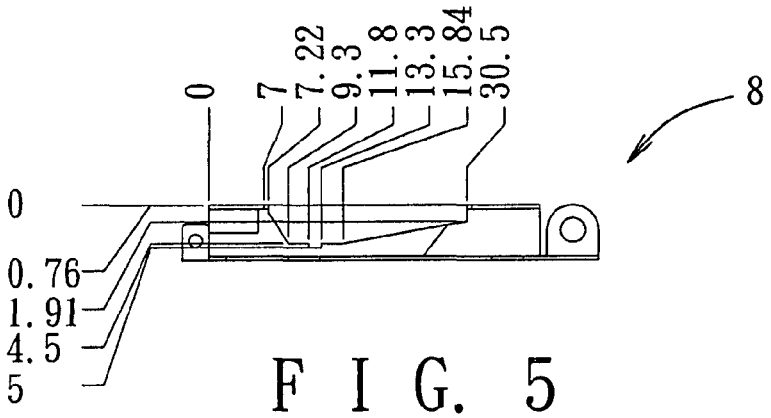
FIG. 5 is a front view showing the dimensions of different portions of the preferred embodiment.
Figure 6:
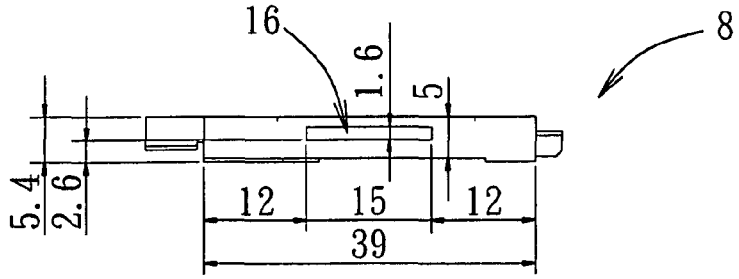
FIG. 6 is a top view showing the dimensions of different portions of the preferred embodiment.
Figure 7:
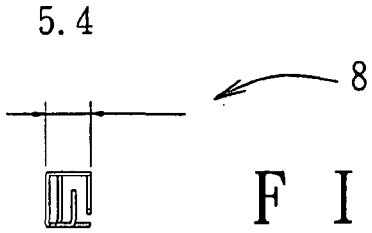
FIG. 7 is a side view showing the dimensions of different portions of the preferred embodiment.

Referring to FIGS. 1 to 3, the preferred embodiment of an antenna according to the present invention is shown to include an elongated folded plate 8 of a conductive material. The folded plate 8 is adapted to be mounted on and coupled electrically to a device, such as a notebook personal computer, and includes: a grounding element 4 extending along a first plane 91; a radiating element 1 having a first side 12 and extending along a second plane 92 substantially parallel to the first plane 91, the radiating element 1 being aligned with the grounding element 4 in a normal direction (y) transverse to the first and second planes 91, 92; a bridging element 3 interconnecting the grounding and radiating elements 4, 1; and a feeding element 2 extending and tapered from the first side 12 of the radiating element 1 toward the grounding element 4 in the normal direction (y) so as to achieve a better impedance match when operated at a lower frequency band of the antenna, thereby increasing the bandwidth of the lower frequency band of the antenna.

In this embodiment, the feeding element 2 has a first end 201 that is connected to the first side 12 of the radiating element 1, a second end 202 that is opposite to the first end 201 in the normal direction (y), and a stub protrusion 21 protruding from the second end 202 of the feeding element 2 toward the grounding element 4. The stub protrusion 21 serves as a feeding point, and is adapted to be connected to a signal unit (not shown), such as a transmitter or a transceiver, through a transmission line (not shown). The feeding element 2 further has two opposing sides 203, 204, each of which cooperates with the second end 202 of the feeding element 2 to define an internal angle $\alpha$, $\beta$ greater than 90 degrees. The grounding element 4 has a first side 401 substantially flush with the first side 12 of the radiating element 1. The second end 202 of the feeding element 2 is flush with and is spaced apart from the first side 401 of the grounding element 4 in the normal direction (y) by a distance that is less than the distance between the first and second ends 201, 202 of the feeding element 2.

In this embodiment, the radiating element 1 further has a second side 11 that is opposite to the first side 12 in a first direction (z) transverse to the normal direction (y). The grounding element 4 further has a second side 402 opposite to the first side 401 of the grounding element 4 in the first direction (z) and flush with the second side 11 of the radiating element 1. The bridging element 3 extends from the second side 11 of the radiating element 1 to the second side 402 of the grounding element 4. The bridging element 3 is trapezoid in shape, and is tapered from the grounding element 4 to the second side 11 of the radiating element 1 so as to achieve a better impedance match when operated at a higher frequency band of the antenna, thereby increasing the bandwidth of the higher frequency band of the antenna.

In this embodiment, the radiating element 1 further has first and second ends 101, 102 opposite to each other in a second direction (x) transverse to the first and normal directions (z, y). The first and second sides 12, 11 of the radiating element 1 are substantially parallel to each other, and extend from the first end 101 of the radiating element 1 to the second end 102 of the radiating element 1.

The bridging element 3 has an end 301 flush with the first end 101 of the radiating element 1. The bridging element 3 cooperates with the radiating and grounding elements 1, 4 to define a recess 6 thereamong. The recess 6 has a length along the second direction (x) that is greater than that of the bridging element 3.

The folded plate 8 further includes a coupling element 5 extending from the second side 11 of the radiating element 1 toward the second side 402 of the grounding element 4 in the normal direction (y) and having an end 501 flush with the second end 102 of the radiating element 1. The coupling element 5 is spaced apart from the second side 402 of the grounding element 4 in the normal direction (y) by a gap 61 to form a capacitance therebetween, which can smooth the frequency response at the low frequency band of the antenna, thereby increasing the bandwidth of the lower frequency band of the antenna. The coupling element 5 is spaced apart from the bridging element 3 in the second direction (x) by a distance. The length of each of the coupling and bridging elements 5, 3 along the second direction (x) is less than the distance between the coupling and bridging elements 5, 3.

In this embodiment, the radiating element 1 includes first and second end portions 14, 15 and a middle portion 13 extending between and from the first end portion 14 to the second end portion 15. The first and second end portions 14, 15 define the first and second ends 101, 102 of the radiating element 1, respectively. The middle portion 13 of the radiating element 1 has a length along the second direction (x) that is greater than those of the first and second end portions 14, 15 of the radiating element 1. The feeding element 2 extends from the middle portion 13 of the radiating element 1 toward the grounding element 4 in the normal direction (y). The bridging element 3 has a main portion 30 extending from the first end portion 14 of the radiating element 1 to the grounding element 4 in the normal direction (y). The coupling element 5 extends from the second end portion 15 of the radiating element 1 toward the grounding element 4 in the normal direction (y) The first end 201 of the feeding element 2 has a length along the second direction (x) that is substantially equal to that of the middle portion 13 of the radiating element 1.

In this embodiment, the middle portion 13 of the radiating element 1 is formed with a slot 16 extending in the second direction (x). The slot 16 has a length along the second direction (x) that is less than that of the middle portion 13 of the radiating element 1. The slot 16 is disposed adjacent to and is aligned with the first end 201 of the feeding element 2 in the first direction (z) so as to increase the flow path of a current fed into the stub protrusion 21 through the transmission line (not shown), thereby increasing the bandwidth of the lower frequency band of the antenna. In addition, the slot 16 provides another resonant frequency differing from the resonant frequency provided by the radiating element 1 itself, and permits the antenna of this invention to be operable at the higher frequency band in addition to the lower frequency band.

In this embodiment, the grounding element 4 is formed with two end ears 41, each of which has a through-hole 411 for extension of a screw fastener (not shown) therethrough to permit mounting of the antenna on a circuit board (not shown).

FIGS. 4 to 7 illustrate the dimensions of different portions, i.e., the radiating element 1, the grounding element 4, the feeding element 2, the bridging element 3, the coupling element 5, the slot 16, and the remainder of the antenna, of the folded plate 8 of the antenna of this invention. In this embodiment, the antenna has a size of 49 mm×5.4 mm×6.6 mm.

Figure 8:
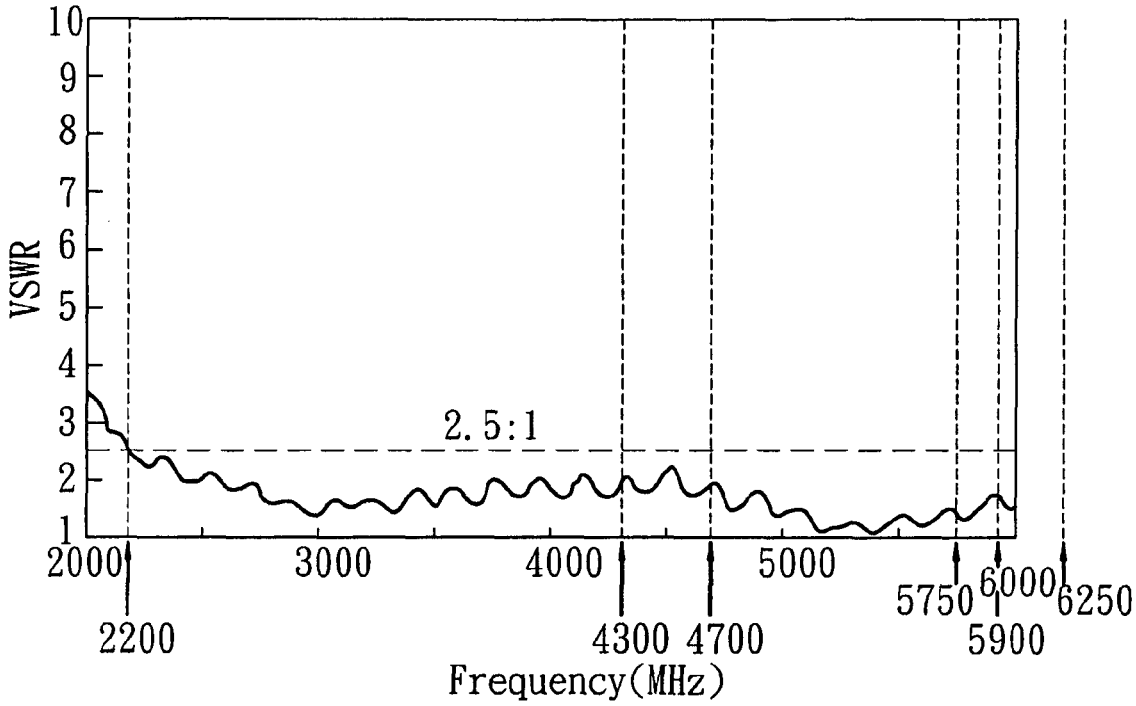
FIG. 8 is a plot of voltage standing wave ratio of the preferred embodiment.

FIG. 8 is a plot of voltage standing wave ratio (VSWR) of the preferred embodiment. As shown in FIG. 8, the VSWR is under 2.5:1 at a frequency within a range from about 2200 MHz to about 6250 MHz. Hence, the antenna of the preferred embodiment is suitable for application to the aforementioned frequency bands, i.e., WiMAX, WLAN, and WPAN.

Table 1 shows the results of measured Total Radiation Power (TRP) and efficiency of the antenna of the preferred embodiment when applied to WiMAX, WLAN, and WPAN frequency bands. As shown in Table 1, the TRP of the preferred embodiment is greater than −4.8 dBm and the efficiency of the preferred embodiment is greater than 33% when operated at a frequency within the WiMAX, WLAN, and WPAN frequency bands.

TABLE 1

| Frequency (MHz) | TRP (dBm) | Efficiency | Peak Gain (dBi) |
|---|---|---|---|
| 2300 | −3.5 | 44.6 | 3.0 |
| 2400 | −3.5 | 44.9 | 3.1 |
| 2412 | −3.4 | 45.8 | 3.0 |
| 2437 | −3.4 | 45.8 | 3.1 |
| 2462 | −3.6 | 43.9 | 2.8 |
| 2500 | −4.0 | 39.9 | 1.9 |
| 2600 | −3.5 | 44.2 | 2.8 |
| 2700 | −3.5 | 44.8 | 3.1 |
| 3168 | −2.9 | 51.8 | 2.9 |
| 3432 | −4.7 | 33.7 | 1.5 |
| 3696 | −3.1 | 49.1 | 2.0 |
| 3960 | −4.3 | 37.0 | 0.7 |
| 4224 | −4.0 | 40.1 | 0.7 |
| 4488 | −4.5 | 35.3 | 0.0 |
| 4752 | −3.7 | 42.8 | 1.8 |
| 4900 | −3.7 | 42.4 | 2.2 |
| 5150 | −3.2 | 47.8 | 3.4 |
| 5350 | −4.0 | 39.4 | 3.0 |
| 5470 | −3.7 | 42.7 | 2.1 |
| 5725 | −4.2 | 37.8 | 1.9 |
| 5875 | −4.4 | 36.4 | 0.9 |

Figure 9:
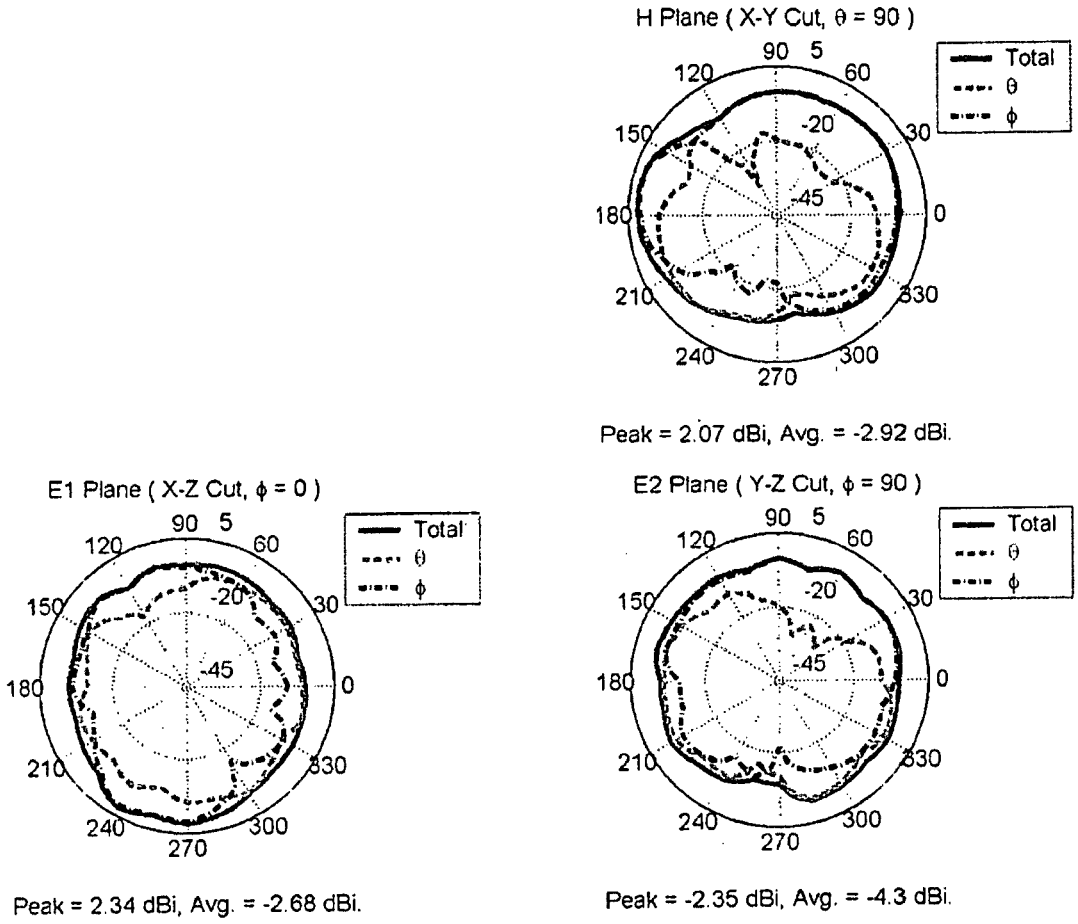
FIG. 9 shows plots of radiation patterns of the preferred embodiment for x-y, x-z, and y-z planes when operated at 2437 MHz.
Figure 10:
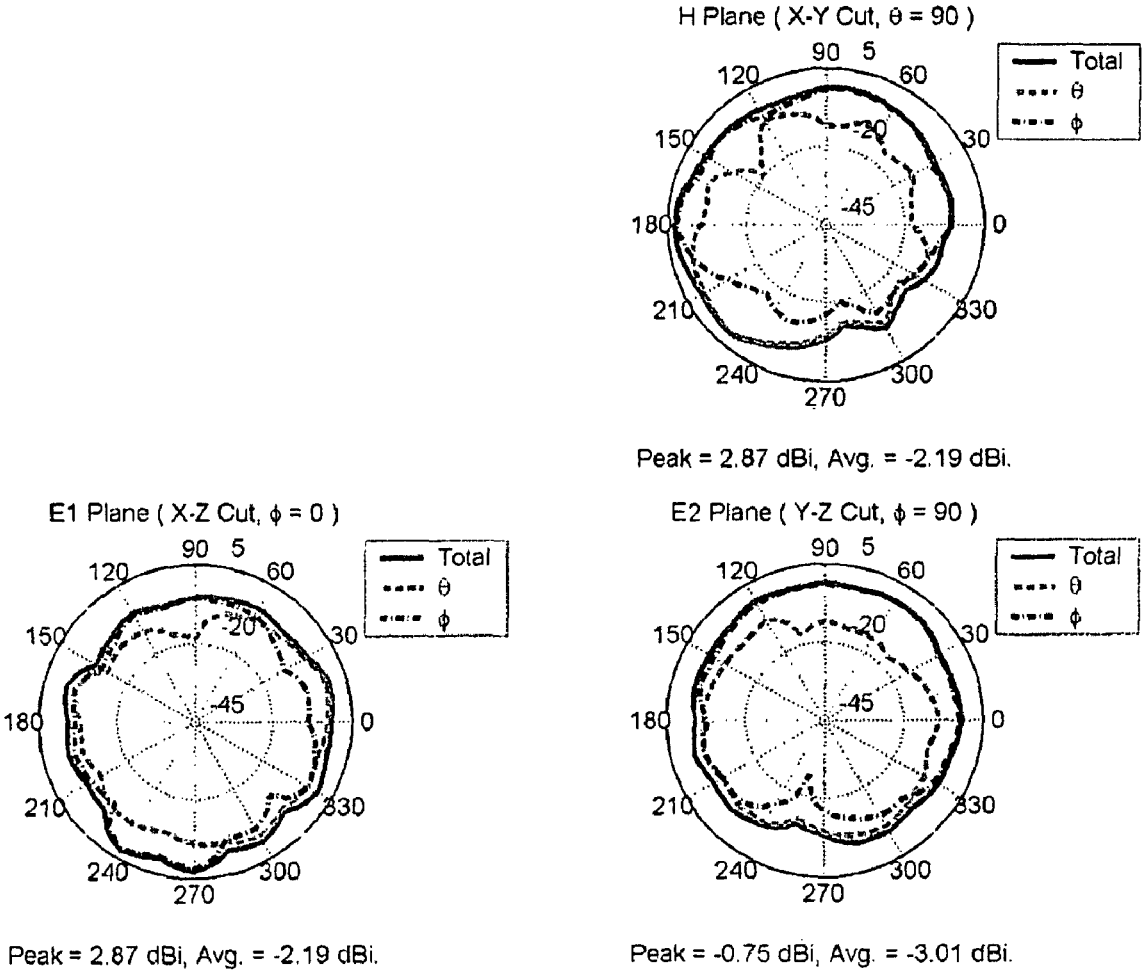
FIG. 10 shows plots of radiation patterns of the preferred embodiment for x-y, x-z, and y-z planes when operated at 3168 MHz.
Figure 11:
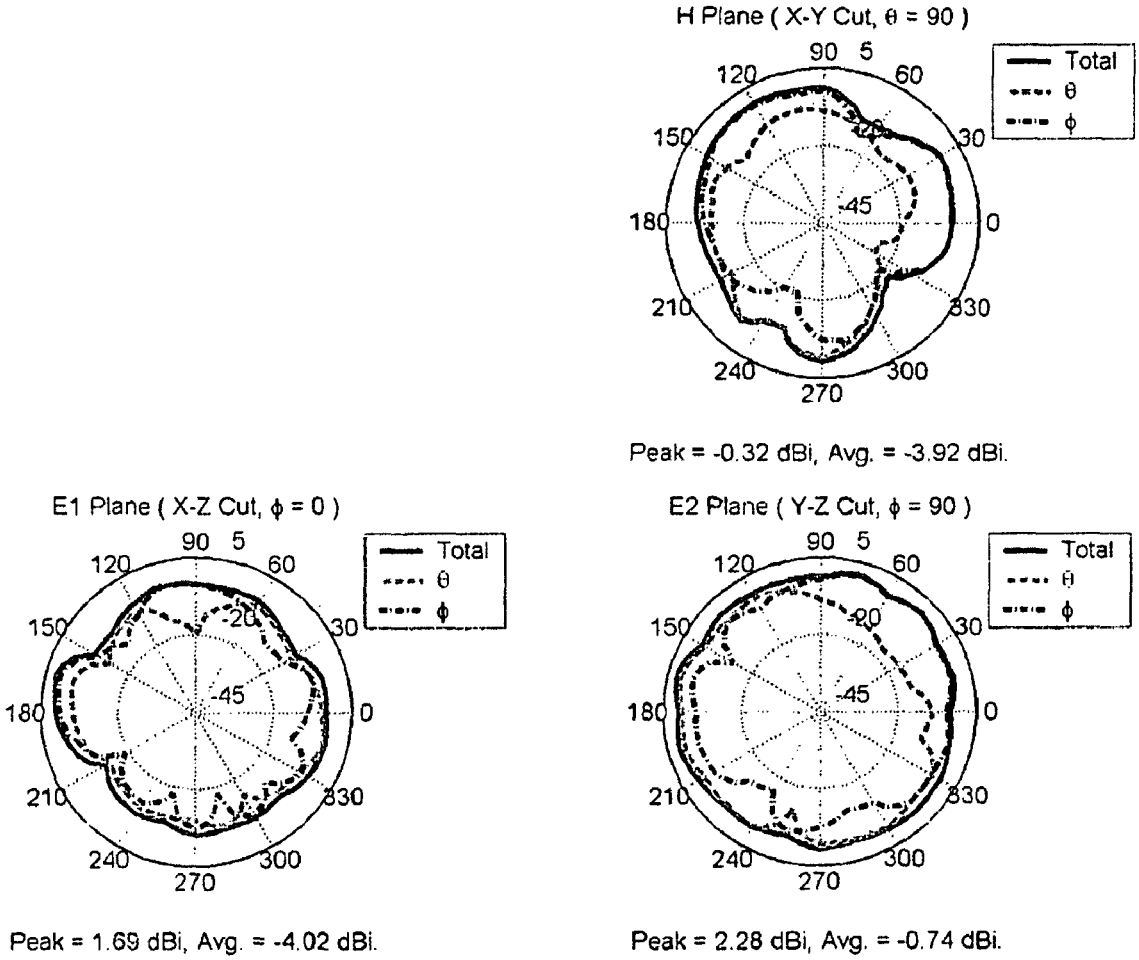
FIG. 11 shows plots of radiation patterns of the preferred embodiment for x-y, x-z, and y-z planes when operated at 5150 MHz.

FIGS. 9 to 11 show the radiation patterns of the preferred embodiment for x-y, x-z, and y-z planes when operated at 2437 MHz, 3168 MHz and 5150 MHz, respectively.

By tapering the feeding element 2 from the radiating element 1, making the bridging element 3 to have a trapezoid shape, forming a capacitance between the coupling element 5 and the grounding element 4, and further forming the slot 16 in the radiating element 1, the operating frequency bandwidth of the antenna of this invention can be considerably increased.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. An antenna comprising:

a grounding element extending along a first plane;

a radiating element having a first side and extending along a second plane substantially parallel to said first plane, said radiating element being aligned with said grounding element in a normal direction transverse to the first and second planes, wherein said radiating element further has a second side that is opposite to said first side in a first direction transverse to the normal direction, said grounding element further having a second side opposite to said first side of said grounding element and flush with said second side of said radiating element, wherein said grounding element has a first side substantially flush with said first side of said radiating element;

a bridging element interconnecting said grounding and radiating elements, said bridging element extending from said second side of said radiating element to said second side of said grounding element, wherein said bridging element is trapezoid in shape, and is tapered from said grounding element to said second side of said radiating element; and a feeding element extending and tapered from said first side of said radiating element toward said grounding element, wherein said feeding element has a first end that is connected to said first side of said radiating element, and a second end that is opposite to said first end in the normal direction said feeding element further having a stub protrusion protruding from said second end of said feeding element toward said grounding element, said second end of said feeding element being flush with and being spaced apart from said first side of said grounding element in the normal direction by a distance that is less than the distance between said first and second ends of said feeding element.

2. The antenna of claim 1, wherein said feeding element extends from said first side of said radiating element toward said grounding element in the normal direction.

3. The antenna of claim 1, wherein said feeding element further has two opposing sides, each of which cooperates with said second end of said feeding element to define an internal angle greater than 90 degrees.

4. The antenna of claim 1, wherein said radiating element further has first and second ends opposite to each other in a second direction transverse to the first and normal directions, said first and second sides of said radiating element being substantially parallel to each other and extending from said first end of said radiating element to said second end of said radiating element, said bridging element having an end flush with said first end of said radiating element.

5. The antenna of claim 4, wherein said bridging element cooperates with said radiating and grounding elements to define a recess thereamong.

6. The antenna of claim 5, further comprising a coupling element extending from said second side of said radiating element toward said second side of said grounding element in the normal direction and having an end flush with said second end of said radiating element, said coupling element being spaced apart from said grounding element in the normal direction by a gap to form a capacitance therebetween.

7. The antenna of claim 6, wherein said coupling element is spaced apart from said bridging element in the second direction by a distance, the length of each of said coupling and bridging elements along the second direction being less than the distance between said coupling and bridging elements.

8. The antenna of claim 6, wherein said radiating element includes first and second end portions and a middle portion extending between and from said first end portion to said second end portion, said first and second end portions defining said first and second ends of said radiating element, respectively, said middle portion of said radiating element having a length along the second direction that is greater than those of said first and second end portions of said radiating element, said feeding element extending from said middle portion of said radiating element toward said grounding element in the normal direction, said bridging element having a main portion extending from said first end portion of said radiating element to said grounding element in the normal direction, said coupling element extending from said second end portion of said radiating element toward said grounding element in the normal direction.

9. The antenna of claim 8, wherein said middle portion of said radiating element is formed with a slot extending in the second direction.

* * * * *